US009453372B2

(12) United States Patent
Stump et al.

(10) Patent No.: US 9,453,372 B2
(45) Date of Patent: Sep. 27, 2016

(54) DRILL WITH INTEGRALLY FORMED BENT SUB AND SONDE HOUSING

(71) Applicant: Eastern Driller Manufacturing Co., Inc., Columbia, PA (US)

(72) Inventors: Timothy Stump, Lancaster, PA (US); Antonio Castrero, Lancaster, PA (US); William Michael Mulligan, West Sacramento, CA (US)

(73) Assignee: EASTERN DRILLER MANUFACTURING CO., INC., Columbia, PA (US)

( * ) Notice: Subject to any disclaimer, the term of this patent is extended or adjusted under 35 U.S.C. 154(b) by 0 days.

(21) Appl. No.: 14/179,072

(22) Filed: Feb. 12, 2014

(65) Prior Publication Data

US 2015/0226005 A1 Aug. 13, 2015

(51) Int. Cl.

| | |
|---|---|
| ***E21B 4/14*** | (2006.01) |
| ***E21B 7/06*** | (2006.01) |
| ***E21B 7/20*** | (2006.01) |

(52) U.S. Cl.

CPC ..... *E21B 4/14* (2013.01); *E21B 7/067* (2013.01); *E21B 7/206* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,937,619 | A | 5/1960 | Kurt | |
| 3,958,645 | A | 5/1976 | Curington | |
| 4,030,554 | A | 6/1977 | Kammerer, Jr. et al. | |
| 4,043,611 | A * | 8/1977 | Wallace | B22F 7/08 175/320 |
| 4,084,646 | A | 4/1978 | Kurt | |
| 4,303,135 | A * | 12/1981 | Benoit | E21B 7/067 175/256 |
| 4,530,408 | A | 7/1985 | Toutant | |
| 4,706,764 | A | 11/1987 | Hughes | |
| 4,821,812 | A | 4/1989 | Ditzig | |
| 5,301,758 | A | 4/1994 | Jenne | |
| 5,337,837 | A | 8/1994 | Wentworth et al. | |
| 5,465,797 | A | 11/1995 | Wentworth et al. | |
| 5,603,383 | A | 2/1997 | Wentworth et al. | |
| 5,680,904 | A | 10/1997 | Patterson | |
| 5,944,117 | A | 8/1999 | Burkholder et al. | |
| 6,386,301 | B1 | 5/2002 | Rear | |
| 6,454,025 | B1 * | 9/2002 | Runquist et al. | 175/61 |
| 6,644,421 | B1 * | 11/2003 | Long | 175/40 |
| 8,544,566 | B2 | 10/2013 | Mulligan | |
| 2004/0040751 | A1 * | 3/2004 | Falvey | E21B 7/04 175/415 |
| 2011/0303464 | A1 | 12/2011 | Mulligan | |

* cited by examiner

*Primary Examiner* — William P Neuder
*Assistant Examiner* — Ronald Runyan
(74) *Attorney, Agent, or Firm* — Panitch Schwarze Belisario & Nadel LLP

(57) ABSTRACT

A fluid-actuated directional percussive impact tool includes a back head for connection to a pressurized fluid source and a tool casing housing a drill bit longitudinally movable with respect thereto. The drill bit has a central axis extending longitudinally therethrough. A sonde housing is coupled between the back head and the tool casing and has a sonde disposed therein. The sonde housing has a central axis extending longitudinally therethrough. A bent sub is integrally formed with the sonde housing and connects the sonde housing to the tool casing such that the central axis of the drill bit intersects the central axis of the sonde housing at a non-zero angle.

8 Claims, 2 Drawing Sheets

DRILL WITH INTEGRALLY FORMED BENT SUB AND SONDE HOUSING

BACKGROUND OF THE INVENTION

Embodiments of the present invention relate to impact tools for use in drilling operations, and more particularly, to fluid-actuated directional drilling equipment with an integrally formed bent sub and sonde housing.

Fluid-actuated directional percussive impact tools, such as drills, are commonly used for directional boring, which allows for the underground installation of pipes, cables, or the like without digging a trench. Drills for such operations typically include a back head for connection to a pressurized fluid source and a tool casing that houses a drill bit. A sonde housing that includes a sonde therein is typically arranged between the back head and the casing. The sonde can be used to transmit data, such as angle, rotation, or direction of the drill, temperature, or the like back to the driller above ground. Typically a bent sub (a small, angled piece of the drill string), is used to connect the sonde housing to the tool casing.

The angle of the bent sub allows the driller to steer the tool casing around obstacles that may be in the way of the planned route and/or to steer up or down to hit a set exit point of the drill. The bent sub is typically threaded on both ends, with one end being threaded onto the sonde housing and the other end being threaded onto the tool casing. However, the threaded connection can come loose while partially turning the tool casing during the steering process. The conventional method used in the industry to prevent loosening of the threaded connection is to weld or epoxy the joint together.

Although welding of the joint may aid in preventing disconnections for the short term, it does not provide a lasting solution. Welding changes the temper of the metal parts of the drill, making them brittle and more susceptible to cracks, which leak pressurized air needed to run the hammer and drill bit in the tool casing. As the hammer slows down due to the air loss, the driller puts more push pressure on the hammer. Eventually the added force causes complete failure at the welded joint. Similar to the weld, epoxy also eventually loosens and allows air leakage. Once loose, old epoxy needs to be removed and reapplied. Removal requires heat from a torch to soften the old epoxy. The heat will also make the metal of the drill brittle and the same type of cracking and failure experienced with welds can occur.

It is therefore desirable to provide a drill with a sonde housing and bent sub that will not loosen during turning of the drill but does not utilize methods that adversely affect the material of the drill to the point of cracking and air leakage.

BRIEF SUMMARY OF THE INVENTION

Briefly stated, an embodiment of the present invention comprises a fluid-actuated directional percussive impact tool including a back head for connection to a pressurized fluid source and a tool casing housing a drill bit longitudinally movable with respect thereto. The drill bit has a central axis extending longitudinally therethrough. A sonde housing is coupled between the back head and the tool casing and has a sonde disposed therein. The sonde housing has a central axis extending longitudinally therethrough. A bent sub is integrally formed with the sonde housing and connects the sonde housing to the tool casing such that the central axis of the drill bit intersects the central axis of the sonde housing at a non-zero angle.

BRIEF DESCRIPTION OF THE DRAWINGS

The foregoing summary, as well as the following detailed description of a preferred embodiment of the invention, will be better understood when read in conjunction with the appended drawings. For the purpose of illustration, there is shown in the drawings an embodiment which is presently preferred. It should be understood, however, that the invention is not limited to the precise arrangements and instrumentalities shown.

DETAILED DESCRIPTION OF THE INVENTION

Figure 1:
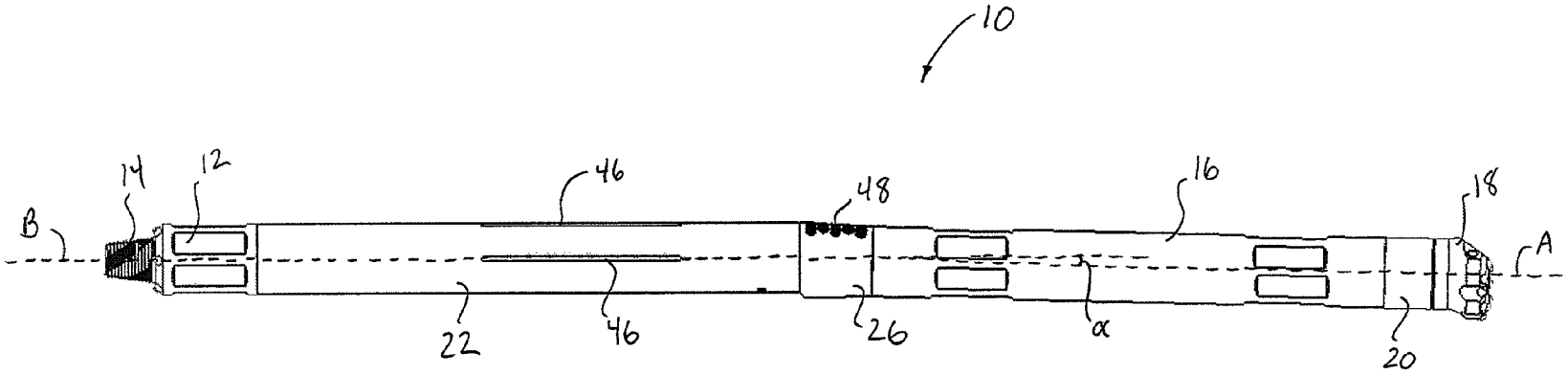
FIG. 1 is a right side elevational view of a fluid-actuated directional percussive impact tool in accordance with a preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the fluid-actuated directional percussive impact tool and designated parts thereof. The terminology includes the above-listed words, derivatives thereof, and words of similar import. Additionally, the words "a" and "an", as used in the claims and in the corresponding portions of the specification, mean "at least one."

Figure 2:
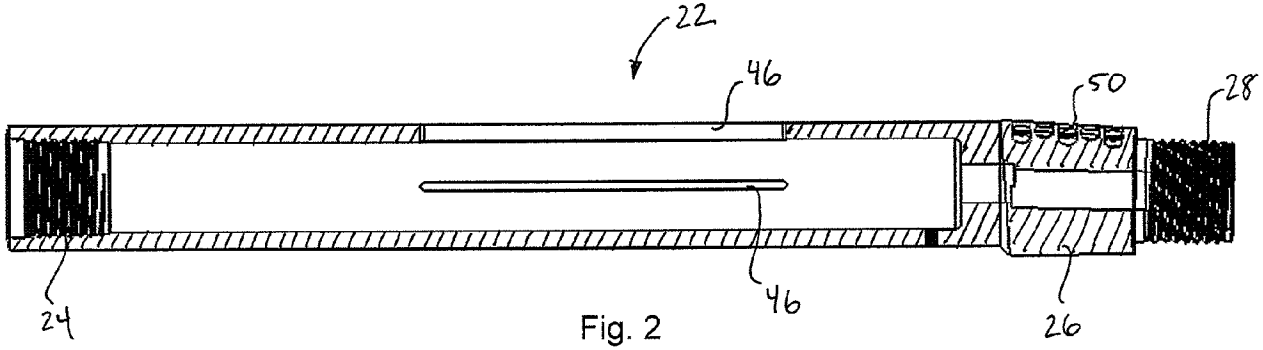
FIG. 2 is an enlarged right side elevational cross-sectional view of the sonde housing and bent sub of the fluid-actuated directional percussive impact tool of FIG. 1.
Figure 3:
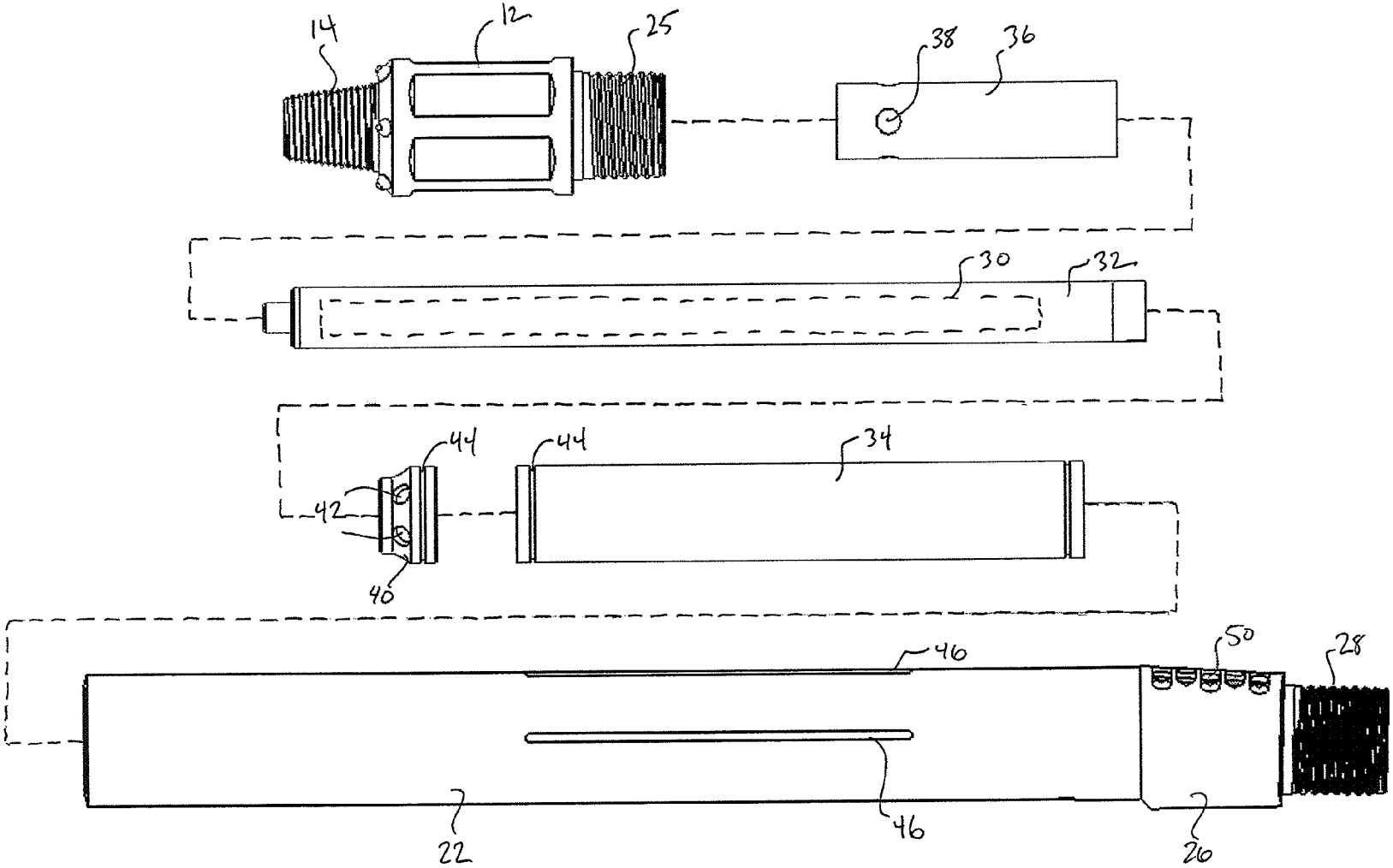
FIG. 3 is an enlarged exploded side elevational view of a portion of the fluid-actuated directional percussive impact tool of FIG. 1.

Referring to the drawings, wherein like numerals indicate like elements throughout, there is shown in FIGS. 1-3, an improved fluid-actuated directional percussive impact tool 10 adapted for directional drilling or boring. The tool or drill 10 is adapted to be placed in a bore using an appropriate drill string (not shown). The drill 10 is provided with a back head 12, which couples the drill string to the remainder of the body of the drill 10. The back head 12 includes a mating threaded section 14 for connection to the drill string. A central channel (not shown) is provided through the back head 12 for passing pressurized fluid from the drill string to the remainder of the drill 10.

The drill 10 further includes a longitudinally extending casing 16. A first end of the casing 16 preferably includes a threaded section (not shown) to facilitate connection to other components of the drill 10 and receiving the fluid provided from the back head 12. An impact receiving device, such as a longitudinally extending percussive drill bit 18 is mounted at a second end of the casing 16. A first end of the drill bit 18 is disposed within the casing 16, and a second end of the drill bit 18 is disposed outside of the casing 16 for impacting the surface (not shown) to be drilled. The drill bit 18 and the casing 16 are longitudinally movable with respect to one another. The percussive drill bit 18 is preferably coupled to the casing 16 by a supporting chuck 20. The supporting chuck 20 is threadedly and removably engaged with the casing 16 at the second end thereof using a thread or the like. The percussive drill bit 18 is mounted for restricted axial movement within the chuck 20. A piston (not shown) is preferably also disposed within the casing 16 and longitudinally movable with respect thereto. The piston oscillates in accordance with the fluid delivery to impart a striking force to the drill bit 18.

A sonde housing 22 is coupled between the back head 12 and the casing 16. In a preferred embodiment, the sonde housing 22 includes a threaded first end 24 for mating with a complimentary threaded section 25 of the back head 12. At a second, opposite end of the sonde housing 22 is a bent sub 26 integrally formed therewith. The bent sub 26 preferably connects the sonde housing 22 to the casing 16 via a threaded end 28. The design shown in the drawings eliminates the need for a threaded or other temporary connection between the sonde housing 22 and the bent sub 26, and removes the need for welding, which tends to weaken the structure as described above.

The sonde housing 22 and bent sub 26 are preferably formed together from a single piece of turned steel. For example, the sonde housing 22 and bent sub 26 can be made by eccentric sleeve turning. One of the sonde housing 22 and bent sub 26 is turned first, then the angle of turning is altered to form the remainder of the one piece construction. However, other materials and manufacturing methods may be used as well.

The sonde housing 22 preferably includes a sonde 30 disposed therein, as is conventionally known. The sonde 30 is preferably contained within a sonde carriage 32, which provides protection to the sensitive electronic components of the sonde 30 from the pressure and impact effects of the drilling operation. However, some components of the sonde 30 may be located outside of the sonde carriage 32, as necessary. The sonde carriage 32 is preferably coaxially disposed within the sonde housing 22. In the embodiment shown in the drawings, a portion of the sonde carriage 32 is radially surrounded by a sleeve 34 that is also contained within the sonde housing 22 and is preferably sealed against an inner surface thereof as described in more detail below.

The sonde carriage 32 is preferably held in place within the sonde housing 22 by an inverter 36 which is coupled within the threaded section 25 of the back head 12 and extends partially into the sonde housing 22. A portion of the inverter 36 preferably radially surrounds and engages an end of the sonde carriage 32. The inverter 36 also serves to divert fluid flow around the sonde carriage 32. Fluid is generally passed through the back head 12 via the central channel. However, the fluid cannot pass through the sonde housing 22 in the same manner because of the presence of the sonde 30. The inverter 36 includes a plurality of holes 38 and is radially spaced from an inner surface of the sonde housing 22 such that fluid passing through the back head 12 exits the inverter 36 through the holes 38 and continues to pass through the sonde housing 22 along an outer surface of the inverter 36. The inverter 36 is preferably made from neoprene or other like synthetic rubbers or polymers.

The inverter 36 is preferably coupled to the sleeve 34 via an adapter 40. An outer surface of the sleeve 34 preferably bears against the inner surface of the sonde housing 22, and therefore the fluid must again be diverted. As a result, the adapter 40 preferably includes a plurality of holes 42 that allow the fluid to enter into the adapter 40. The adapter 40 and the sleeve 34 also each preferably include at least one sealing slot 44 configured to receive an O-ring (not shown), which seals the respective components against the inner surface of the sonde housing 22, thereby forcing the fluid into the holes 42 of the adapter 40. Other types of seals may be provided, however. Once the fluid enters into the adapter 40, it may be passed into the sleeve 34, an inner surface of which is preferably radially spaced apart from the sonde carriage 32. The fluid passes through this space and eventually into the casing 16.

Although a preferred structure and method of passing the fluid from the back head 12 to the casing. 16 via the sonde housing 22 has been described, other structures and methods can be used as well without departing from the spirit of the invention.

The sonde housing 22 preferably also includes a plurality of longitudinally extending slots 46 formed through the outer and inner surfaces thereof for accessing the central cavity housing the sleeve 34 and the sonde carriage 32. The slots 46 are provided to allow radio waves generated by the sonde 30 to emerge unimpeded from the sonde housing 22. The radio waves are utilized to, among other things, track the location and orientation of the drill 10. Preferably the angle of the drill bit 18 is timed to the orientation of the slots 46 to increase the accuracy of position and orientation detection.

The bent sub 26 is provided so that a central axis A extending longitudinally through the drill bit 18 intersects a central axis B extending longitudinally through the sonde housing 22 at a non-zero angle $\alpha$. As described above, the non-zero angle $\alpha$ created by the bent sub 26 allows the operator to steer the drill bit 18 and casing 16 around obstacles in the drilling path and approach set exit locations. The non-zero angle $\alpha$ is preferably between about 1° and 2°, and more preferably is about 1.5°. However, other non-zero angles $\alpha$ may be used as well in keeping with the invention.

The bent sub 26 also preferably includes at least one buffer 48 protruding from an exterior surface thereof. The buffer 48 is preferably formed from a carbide or other high-strength, rugged material and is used to prevent excessive wear on the bent sub 26. The at least one buffer 48 may be provided in one or more corresponding grooves 50 formed in the exterior surface of the bent sub 26 and may be attached by the use of adhesives, positive fit, welding, or the like.

From the foregoing, it can be seen that embodiments of the present invention comprise fluid-actuated directional drilling equipment. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A fluid-actuated directional percussive impact tool comprising:

(a) a back head for connection to a pressurized fluid source;

(b) a tool casing housing a drill bit longitudinally movable with respect thereto, the drill bit having a central axis extending longitudinally through the drill bit;

(c) a sonde housing coupled between the back head and the tool casing and having a sonde disposed therein, the sonde housing having a central axis extending longitudinally therethrough; and (d) a bent sub integrally formed with the sonde housing and connecting the sonde housing to the tool casing such that the central axis of the drill bit intersects the central axis of the sonde housing at a non-zero angle, wherein the sonde housing and the bent sub are formed from a single piece of turned steel.

2. The tool of claim 1, wherein the sonde is disposed within a sonde carriage which is disposed coaxially within the sonde housing.

3. The tool of claim 1, further comprising at least one carbide buffer protruding from an exterior surface of the bent sub.

4. The tool of claim 1, wherein the angle is about 1.5 degrees.

5. The tool of claim 1, wherein the bent sub includes a threaded portion and a non-threaded portion, an exterior surface of the non-threaded portion remains exposed when the bent sub is connected to the tool casing.

6. A fluid-actuated directional percussive impact tool comprising:

(a) a back head for connection to a pressurized fluid source;

(b) a tool casing housing a drill bit longitudinally movable with respect thereto, the drill bit having a central axis extending longitudinally through the drill bit;

(c) a sonde housing coupled between the back head and the tool casing and having a sonde disposed therein, the sonde housing having a central axis extending longitudinally therethrough, the sonde being disposed within a sonde carriage which is disposed coaxially within the sonde housing;

(d) a sleeve radially surrounding at least a portion of the sonde carriage with an inner surface being radially spaced apart from the sonde carriage, the sleeve being contained in the sonde housing; and (e) a bent sub integrally formed with the sonde housing and connecting the sonde housing to the tool casing such that the central axis of the drill bit intersects the central axis of the sonde housing at a non-zero angle, wherein the sonde housing and the bent sub are formed from a single piece of turned steel.

7. The tool of claim 6, further comprising at least one seal between an outer surface of the sleeve and an inner surface of the sonde housing.

8. A fluid-actuated directional percussive impact tool comprising:

(a) a back head for connection to a pressurized fluid source;

(b) a tool casing housing a drill bit longitudinally movable with respect thereto, the drill bit having a central axis extending longitudinally through the drill bit;

(c) a sonde housing coupled between the back head and the tool casing and having a sonde disposed therein, the sonde housing having a central axis extending longitudinally therethrough, the sonde being disposed within a sonde carriage which is disposed coaxially within the sonde housing; and (d) a bent sub integrally formed with the sonde housing and connecting the sonde housing to the tool casing such that the central axis of the drill bit intersects the central axis of the sonde housing at a non-zero angle, wherein the sonde housing and the bent sub are formed from a single piece of turned steel, and wherein a portion of the sonde carriage is radially surrounded by an inverter coupled to the sleeve and the back head, the inverter having a plurality of holes formed therein to divert fluid from the back head around the sonde carriage.

* * * * *